US009683396B2

(12) United States Patent
Braselton

(10) Patent No.: US 9,683,396 B2
(45) Date of Patent: Jun. 20, 2017

(54) SAFETY DEVICE FOR LOCKABLE RECEPTACLES

(71) Applicant: Jeffrey Hal Braselton, Lubbock, TX (US)

(72) Inventor: Jeffrey Hal Braselton, Lubbock, TX (US)

( * ) Notice: Subject to any disclaimer, the term of this patent is extended or adjusted under 35 U.S.C. 154(b) by 227 days.

(21) Appl. No.: 14/488,572

(22) Filed: Sep. 17, 2014

(65) Prior Publication Data

US 2015/0091313 A1 Apr. 2, 2015

Related U.S. Application Data

(60) Provisional application No. 61/885,073, filed on Oct. 1, 2013.

(51) Int. Cl.
*E05C 17/44* (2006.01)
*E05C 17/50* (2006.01)

(52) U.S. Cl.
CPC ..... *E05C 17/50* (2013.01); *Y10T 292/71* (2015.04)

(58) Field of Classification Search
CPC ..... E05F 2005/046; E05F 5/02; E05F 5/06; E05Y 2201/224; E05Y 2800/41; Y10T 16/61; Y10T 292/71; E05C 17/025; E05C 17/54; E05C 17/50; E05C 17/04; E05C 17/00; Y10S 292/15; Y10S 16/17; E06B 7/36
USPC ..... 292/342
See application file for complete search history.

(56) References Cited

U.S. PATENT DOCUMENTS

| | | | | |
|---|---|---|---|---|
| 5,509,235 | A * | 4/1996 | Chander | E05C 17/025 160/40 |
| 5,648,152 | A * | 7/1997 | Diaz-Kotti | C08K 5/29 139/383 R |
| 8,276,240 | B2 * | 10/2012 | Ritachka | E05F 5/02 16/82 |
| 8,453,384 | B2 | 6/2013 | Boyer | |
| 8,595,899 | B2 * | 12/2013 | McRoskey | E05F 5/04 16/82 |
| 2005/0241238 | A1 | 11/2005 | Garvey | |
| 2010/0257788 | A1 | 10/2010 | McRoskey | |
| 2012/0079680 | A1 * | 4/2012 | McRoskey | E05F 5/04 16/83 |
| 2013/0118087 | A1 | 5/2013 | Belyea et al. | |

* cited by examiner

*Primary Examiner* — Mark Williams
(74) *Attorney, Agent, or Firm* — Sarah Hegi Simpson; McWhorter, Cobb & Johnson, LLP

(57) ABSTRACT

A safety device for doors of lockable receptacles and a method of use are disclosed herein. The disclosed safety device generally comprises a base member attachable to a lockable receptacle; an arm member having a proximal end and a distal end, wherein the proximal end is attached to the base member; and a wedge member forming a portion of the arm member. Upon opening the door of the lockable receptacle, the wedge member becomes positioned between the open door and the lockable receptacle, thereby preventing closure of the door on a user's body part positioned between the door and the lockable receptacle.

20 Claims, 6 Drawing Sheets

SAFETY DEVICE FOR LOCKABLE RECEPTACLES

CROSS-REFERENCE TO RELATED APPLICATIONS

This application is related to and claims priority from earlier filed U.S. Provisional Patent Application No. 61/885,073, filed Oct. 1, 2013, the disclosure of which is incorporated herein by reference.

BACKGROUND OF THE INVENTION

1. Field of the Invention

The present invention generally relates to a safety device for doors. More specifically, the present invention relates to a safety device for doors of lockable receptacles (e.g., safes, vaults, fire-resistant cabinets, automatic teller machines, etc.) that is designed to prevent injuries resulting from user's body parts (e.g., fingers and hands) being crushed by a closing door.

2. Description of Related Art

Currently, many different safety devices for doors are available for preventing door-related injuries caused by body parts being pinched, trapped, or crushed by a closing door. For example, rubber safety strips are often added to cover the hinge side of doors. Such devices prevent finger trapping accidents by completely covering the gap that is created on the hinge side of a door when the door is in an open position. Other door safety devices (e.g., door stops, door holders, door bumpers, etc.) prevent injuries by holding doors in fully or partially open positions. These devices prevent latching or complete closure of a door and help prevent small fingers and hands from being pinched or crushed in doors and door hinges. For example, door bumpers are made of pliable foam or rubber like material and are configured to attach to the handle-side edge of a door in order to form a soft cushion between the edge of the door and the door frame to prevent the door from completely closing when the door is slammed shut.

While many safety devices for doors currently exist, current devices are designed for use on conventional interior doors of homes to protect people, especially children, from injuring their fingers, hands, etc. from being pinched or caught in a doorjamb. These current devices are not designed or appropriate for use on doors of safes and similar lockable receptacles that include doors weighing hundreds or even thousands of pounds.

The disclosed device is especially designed for use on a safe or the like, especially large-size stationary safes that are often used in businesses such as banks, jewelry stores, or any other business that stores large amounts of money or valuables. Such safes are generally box-shaped and include a lockable, outwardly swinging door hinged to a side wall of the safe for permitting and preventing access to the interior of the safe. These safes typically weigh one thousand or more pounds each and the door of such a safe weighs approximately one-third of the total weight of the safe. Due to the durability, size, and weight of safe doors, inadvertently closing a safe door on one's fingers or hand results in severe injuries and oftentimes requires amputation of the injured body part.

Current door safety devices are not designed for use with doors of lockable receptacles such as safes and the like. Current devices made for conventional interior doors, which weigh a fraction of the weight of safe doors, are not sturdy enough for use with safes. The cushiony foam-like material used to make many current devices does not prevent a heavy safe door from completely closing and latching, and therefore, does not prevent injuries of body parts positioned between a safe and a closing door. Additionally, the purpose of safes is to lock away and protect valuables. Therefore, devices designed to hold doors in fully or partially open positions are not practical for use with safes.

Currently, a need exists for a safety device that protects users' body parts from being injured by a closing door of a lockable receptacle such as a safe. A safety device is needed that is made of a strong, durable material that can withstand the force of a closing door weighing hundreds or even thousands of pounds. Additionally, the safety device must allow the door of the lockable receptacle to properly latch and lock away valuables stored inside the lockable receptacle. Furthermore, a device is needed that prevents a large, heavy door of a lockable receptacle from injuring a user when the door inadvertently closes while a body part of the user is positioned between the lockable receptacle and the closing door.

In view of the foregoing, it is apparent that a need exists in the art for a safety device for doors of lockable receptacles which overcomes, mitigates or solves the above problems in the art. It is a purpose of this invention to fulfill this and other needs in the art which will become more apparent to the skilled artisan once given the following disclosure.

OBJECTS AND SUMMARY OF THE INVENTION

It is an object of the present invention to overcome the above described drawbacks associated with current devices. To achieve these and other advantages and in accordance with the purpose of the invention, as embodied and broadly described, the present disclosure describes a safety device for doors of lockable receptacles, such as safes and the like.

The disclosed device generally comprises a base member attachable to a lockable receptacle; an arm member having a proximal end and a distal end, wherein the proximal end is attached to the base member; and a wedge member forming a portion of the arm member, wherein upon opening the door of the lockable receptacle, the wedge member becomes positioned between the open door and the lockable receptacle, thereby preventing closure of the door on a user's body part positioned between the door and the lockable receptacle.

One object of the disclosed invention is to protect users' body parts from being injured by a closing door of a lockable receptacle, such as a safe. Unlike existing door safety devices, the present device is made of a strong, durable material that can withstand the force of a closing door weighing hundreds or even thousands of pounds. For example, the device may be made of steel, stainless steel, or any other material that is sturdy enough to withstand the force of a lockable receptacle door being slammed shut. Additionally, the disclosed device is uniquely configured to withstand the hundreds or thousands of pounds of force that may be exerted upon the safety device upon closure of a door of a lockable receptacle.

Another object of the disclosed device is to allow doors of lockable receptacles to properly latch and lock away valuables stored inside the lockable receptacle. The disclosed device is configured so that a door of a lockable receptacle can be opened without touching or moving the safety device. The wedge member on the arm member of the device is configured so that upon opening the door, the door automatically forces the distal end of the arm member to pivot upwardly as the door opens (see FIG. 6). Once the door is opened to allow access to the interior of the safe, the arm member of the device, including the wedge member, pivots downwardly so that the wedge member is positioned between the safe and the open door (see FIG. 7). As a result, if the door attempts to close, the wedge member prevents the door from completely closing. In order to close the door, the distal end of the arm member of the device must be lifted upwardly by lifting the handle of the device, so that the wedge member no longer blocks or prevents the door from closing completely (see FIG. 8). In this manner, the user must use two hands to close the safe. One hand lifts the handle of the disclosed safety device upwardly, while the other hand pushes against the door handle on the safe. Since the user must use both hands to lift the safety device and close the door, the user does not risk inadvertently closing the door on the user's fingers or hand. In addition to preventing severe injuries from occurring to users, the disclosed method of use is an incredibly simple and affordable safety measure for companies to implement.

These, together with other objects of the invention, along with various features of novelty that characterize the invention, are pointed out with particularity in the claims annexed hereto and forming a part of this disclosure. For a better understanding of the invention, its operating advantages, and the specific objects attained by its uses, reference should be had to the accompanying drawings and descriptive matter in which there is described illustrative embodiments of the invention.

BRIEF DESCRIPTION OF THE DRAWINGS

The accompanying drawings, which are incorporated in and form a part of the specification, illustrate embodiments of the present invention, and together with the description, serve to explain the principles of the invention. It is to be expressly understood that the drawings are for the purpose of illustration and description only and are not intended as a definition of the limits of the invention. In the drawings.

DETAILED DESCRIPTION OF ILLUSTRATIVE EMBODIMENTS

The terms "top," "bottom," "side," "front," "upwardly," and "downwardly" are used in the specification to describe the embodiment of the invention as illustrated in the accompanying Figures. It should be appreciated that in actual use, an embodiment of the invention may be rotated as needed to accomplish the objectives of the invention. As a result of such rotation, the various terms used herein of "top," "bottom," "side," "front," "upwardly," "downwardly" and the like may not literally apply to a particular arrangement. Such terms are relative and are used herein to describe the Figures for illustration purposes only and are not intended to limit the embodiments shown to any particular orientation.

Figure 1:
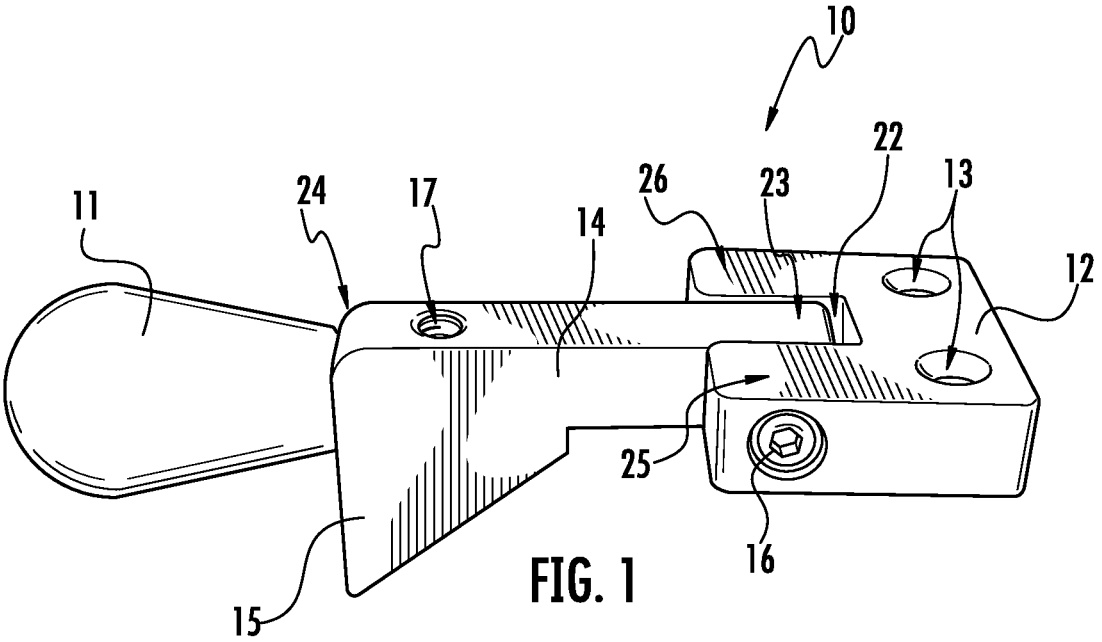
FIG. 1 is a perspective view of a safety device constructed in accordance with the teachings of the present disclosure.
Figure 2:
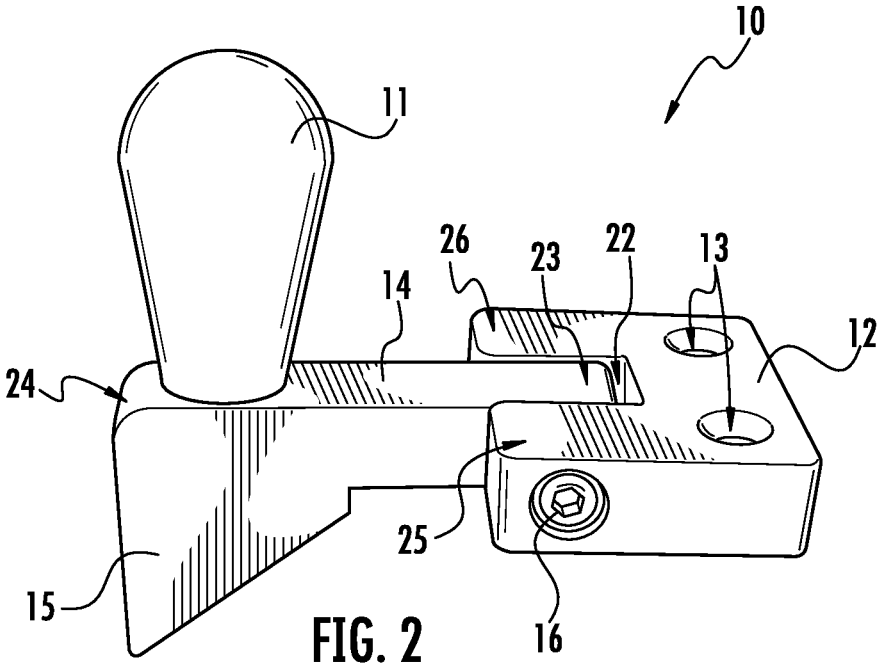
FIG. 2 is a perspective view of the safety device shown in FIG. 1 with the handle in an alternative position.
Figure 3:
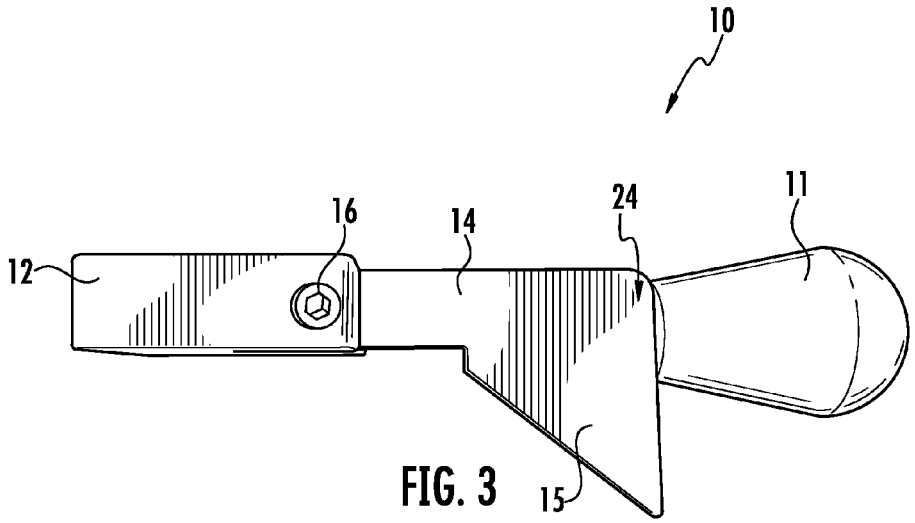
FIG. 3 is a side view of the device shown in FIG. 1.
Figure 4:
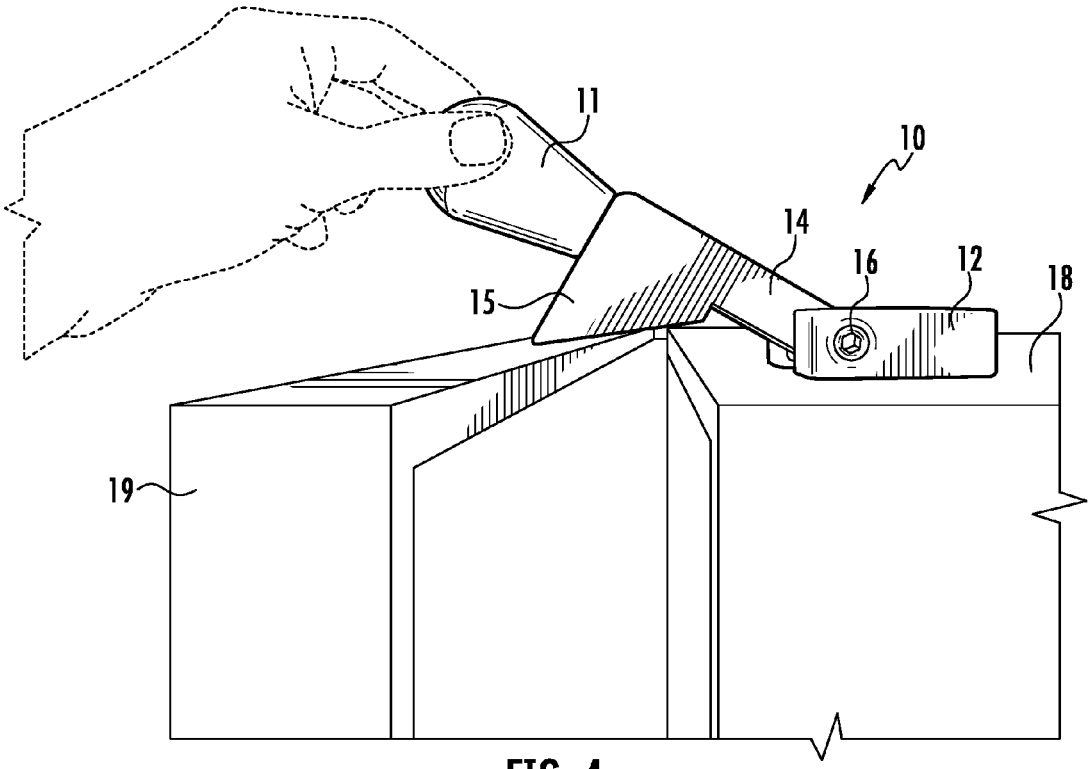
FIG. 4 is a perspective view of the device shown in FIG. 1, wherein the device is attached to a lockable receptacle and the device is being lifted to allow closure of a door of a lockable receptacle.

Referring now to FIGS. 1-8, exemplary embodiments of a safety device 10 for lockable receptacles 18 and methods of use in accordance with the present disclosure are illustrated. Turning to FIGS. 1-3, a safety device 10 according to the present disclosure is illustrated and generally includes a base member 12 attachable to a lockable receptacle 18; an arm member 14 having a proximal end 23 and a distal end 24, wherein the proximal end 23 is attached to the base member 12; and a wedge member 15 forming a portion of the arm member 14.

The safety device 10 according to the present disclosure includes a base member 12 attachable to a lockable receptacle 18. The base member 12 may include attachment members 13 for attaching the base member 12 to the lockable receptacle 18. The accompanying Figures depict the attachment members 13 as apertures for receiving fasteners for attaching the base member 12 to the lockable receptacle 18. One skilled in the art can appreciate that there are many other possibilities that exist for attaching the base member 12 to a lockable receptacle 18, all of which are considered to be within the spirit and scope of the present invention. Additionally, in the embodiment depicted in FIGS. 1 and 2, the device 10 includes two attachment members 13; however, other embodiments are contemplated wherein greater or lesser numbers of attachment members 13 are utilized to attach the base member 12 to a lockable receptacle 18. Moreover, those skilled in the art will recognize that the base member 12 may be permanently or temporarily attached to a lockable receptacle 18 in a manner that does not require attachment members 13, as the various embodiments of the present invention are not limited to the use of attachment members 13 for attaching the base member 12 to a lockable receptacle 18. For example, the base member 12 may be welded, soldered, etc. to the lockable receptacle 18.

The safety device 10 according to the present disclosure further includes an arm member 14 having a distal end 24 and a proximal end 23. The proximal end 23 of the arm member 14 is attached to the base member 12. As shown in the accompanying Figures, a fastener 16 may be utilized for pivotally attaching the arm member 14 to the base member 12. In the depicted embodiment, the base member 12 is U-shaped and the proximal end 23 of the arm member 14 is disposed within the cavity 22 formed in the U-shaped base member 12 so that the fastener 16 can extend through the first projection 25 of the U-shaped base member 12 and then through the proximal end 23 of the arm member 14 and then through the second projection 26 of the U-shaped base member 12. As will be appreciated by those skilled in the art, the base member 12 may be configured in a variety of ways in order to provide for attachment of the proximal end 23 of the arm member 14 to the base member 12, all of which embodiments are considered to be within the spirit and scope of the present invention.

Figure 6:
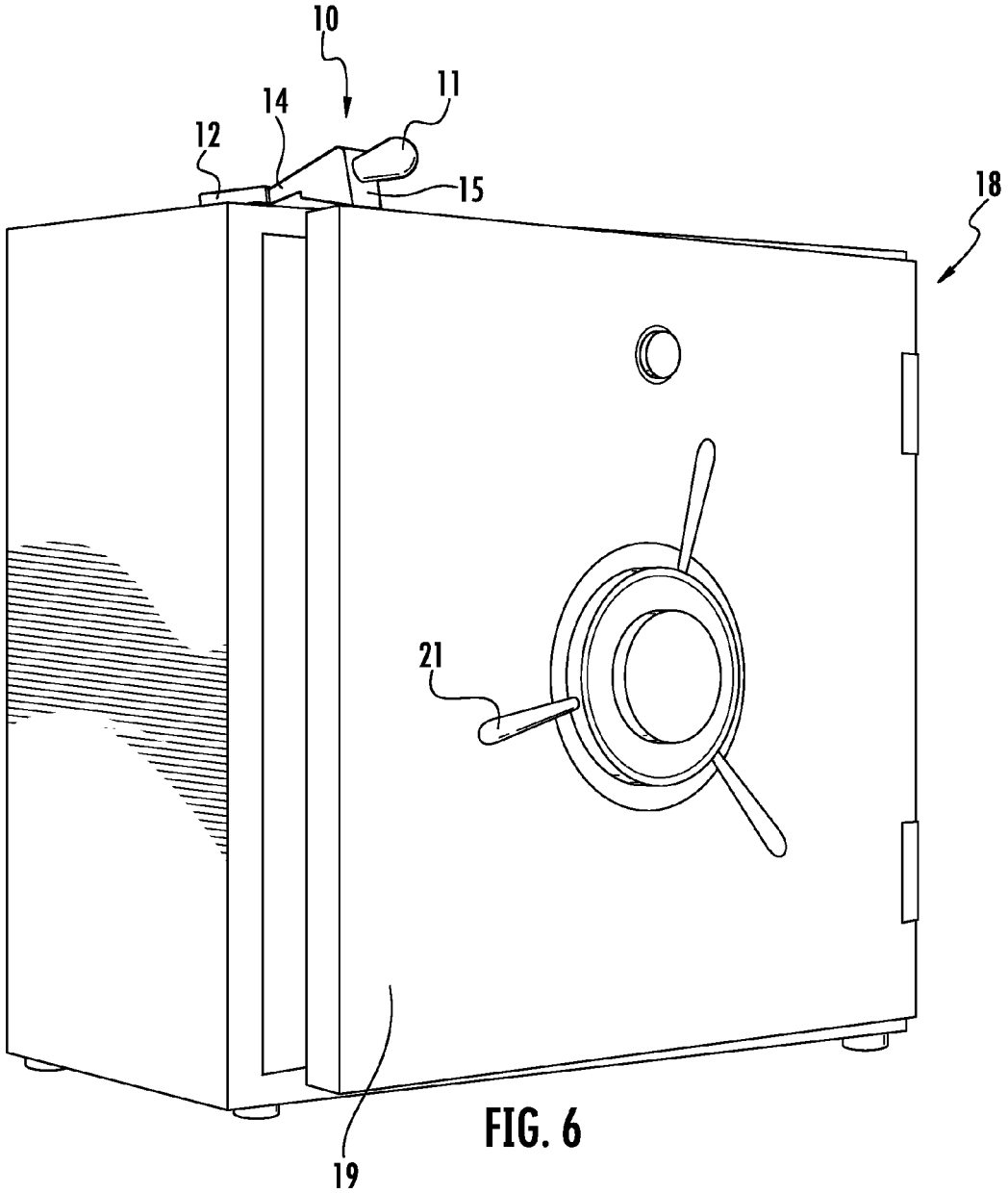
FIG. 6 is a perspective view of the device shown in FIG. 1, wherein the device is attached to a lockable receptacle and the door of the lockable receptacle is being opened.

The arm member 14 further includes a wedge member 15 forming a portion of the arm member 14. In the depicted embodiment, the wedge member 15 is located on the distal end 24 of the arm member 14. However, the arm member 14 may be extended to form a handle so that the wedge member 15 is located toward the center portion of the arm member 14. Preferably, the wedge member 15 is designed to allow the door 19 of the lockable receptacle 18 to open without the door 19 being hindered or obstructed by the safety device 10. In other words, the wedge member 15 is preferably configured so that a user does not have to manually lift the handle member 11 of the safety device 10 in order to open the door 19 of the lockable receptacle 18. As shown in the accompanying Figures, the wedge member 15 may be triangular-shaped. This configuration, allows the distal end 24 of the arm member 14 of the device 10 to easily pivot upwardly to allow for opening of the door 19 of the lockable receptacle 18 without hindering or obstructing the movement of the door 19 to an open position, and without requiring the user to manually lift the handle member 11 of the safety device 10 in order to open the door 19, as shown in FIG. 6. Other embodiments are contemplated wherein the wedge member 15 is shaped in various manners. For example, the wedge member 15 may be substantially square or rectangular in shape. Such alternative embodiments may require a user to manually lift the arm member 14 in order to open the door 19 of the lockable receptacle 18.

Figure 7:
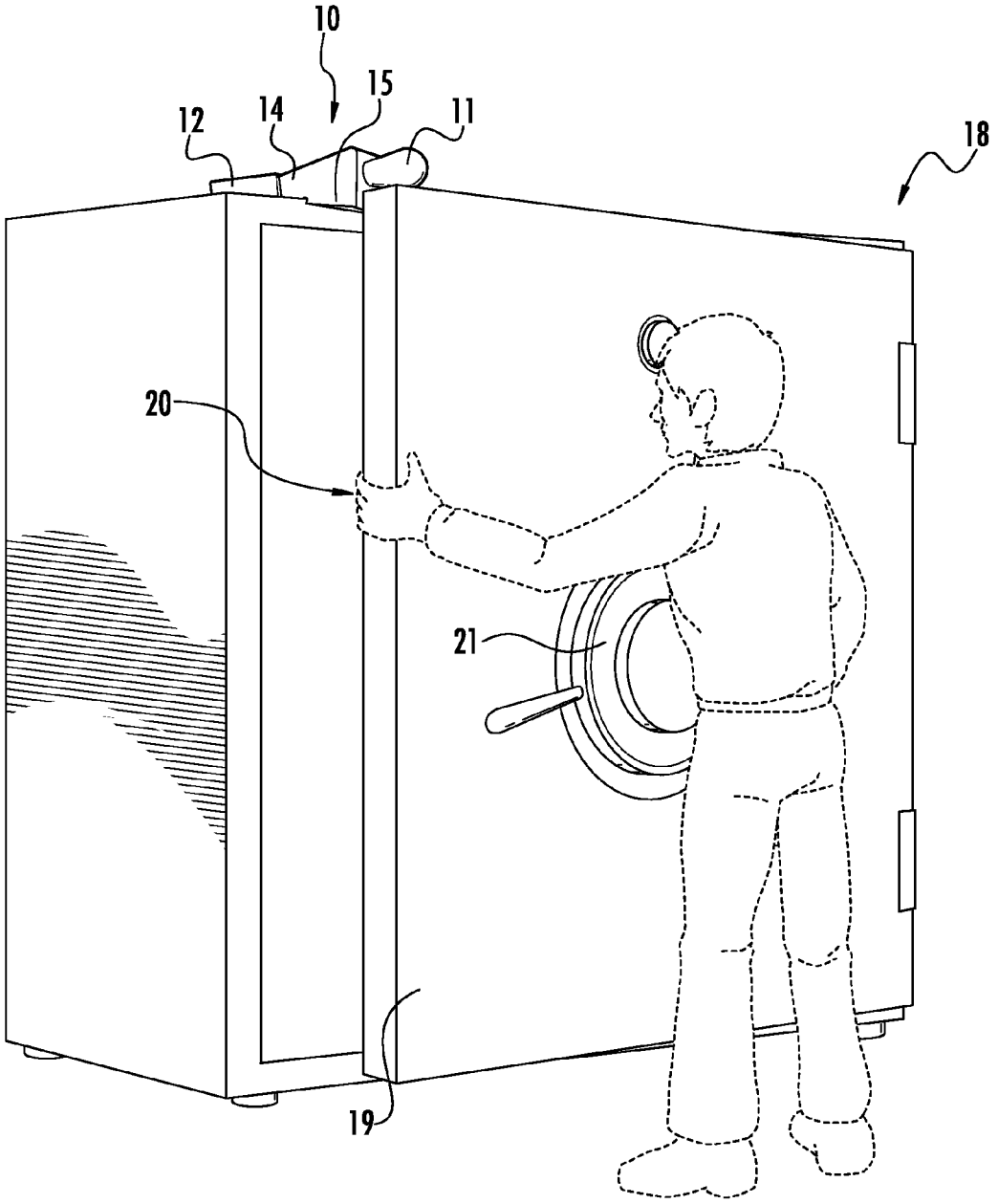
FIG. 7 is a perspective view of the device shown in FIG. 1, wherein the device is attached to a lockable receptacle and the device is preventing injury of the user's fingers and hand by preventing closure of the door of the lockable receptacle.

Once the door 19 opens, the wedge member 15 is designed to fall between the open door 19 and the lockable receptacle 18 and thereby prevents complete closure of the door 19, as shown in FIG. 7. In order to completely close and latch the door 19 of the lockable receptacle 18, the distal end 24 of the arm member 14 of the safety device 10, including the wedge member 15, must be manually lifted upwardly (in the orientation shown in FIG. 8) so that the wedge member 15 does not obstruct closure of the door 19 of the lockable receptacle 18. Once the wedge member 15 is lifted so that it no longer obstructs closure of the door 19, the door 19 can be pushed closed by the user.

As shown in the accompanying Figures, the safety device 10 according to the present disclosure may further include a handle member 11 for moving, pivoting or lifting the distal end 24 of the arm member 14 of the device 10 in order to move or reposition the wedge member 15. The handle member 11 may be designed in a variety of ways, as will be appreciated by those skilled in the art. Additionally, the handle member 11 may attach to the arm member 14 in various ways. FIGS. 1 and 2 depict two different positions in which the handle member 11 may be attached to the arm member 14. Depending on the surface (e.g., top surface or side surface) of the lockable receptacle 18 to which the base member 12 is attached and depending on the height of the lockable receptacle 18, the handle member 11 may be attached to the arm member 14 in various positions. In the embodiment depicted in FIGS. 1 and 2, the arm member 14 includes two handle connection members 17 for attaching the handle member 11 to the arm member 14 in two different positions. FIG. 1 shows the handle member 11 connected to a handle connection member 17 formed in a front side surface of the arm member 14, and FIG. 2 shows the handle member 11 connected to a handle connection member 17 formed in the top surface of the arm member 14. In the depicted embodiment, the handle connection members 17 are shown as threaded apertures. In this embodiment, the handle member 11 may include a threaded fastener (not illustrated) protruding from the bottom portion of the handle member 11. The threaded fastener of the handle member 11 can be received by a handle connection member 17 for connecting the handle member 11 to the arm member 14. As will be appreciated by those skilled in the art, the handle member 11 can be connected to the arm member 14 in various ways. Certain embodiments may not include a handle member 11, and other embodiments may include a handle member 11 formed as one integral piece with the arm member 14. All such embodiments are considered to be within the spirit and scope of the present invention.

Figure 5:
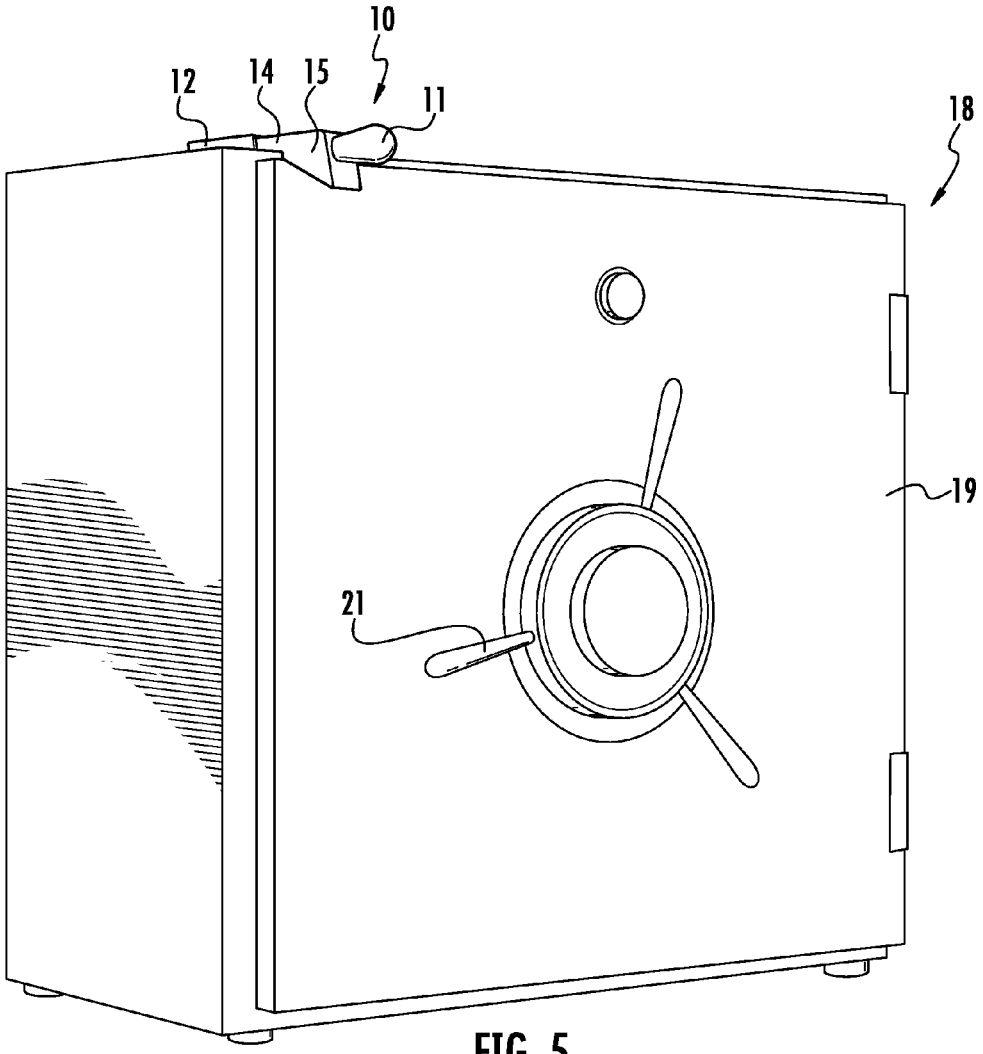
FIG. 5 is a perspective view of the device shown in FIG. 1, wherein the device is attached to a lockable receptacle and the door of the lockable receptacle is closed completely.

Turning to FIGS. 5-8, the device 10 is shown attached to a top surface of a lockable receptacle 18. In FIG. 5, the door 19 of the lockable receptacle 18 is locked and completely closed. FIG. 6 shows the door 19 of the lockable receptacle 18 moving to an open position, wherein the distal end 24 of the arm member 14 of the device 10, including the wedge member 15, is pivoting upwardly to allow for opening of the door 19 of the lockable receptacle 18 without hindering or obstructing the movement of the door 19 to an open position and without requiring the user to manually lift the handle member 11 of the safety device 10 in order to open the door 19. The user must simply unlock the lockable receptacle 18 and pull on the handle 21 of the lockable receptacle 18 to open the door 19.

FIG. 7 shows a user holding a door 19 in a manner that often results in the user severely injuring his fingers and/or hand. Oftentimes, in order to prevent closure of a lockable receptacle door 19, the user grabs the door 19 as shown in FIG. 7. Unfortunately, this automatic reaction by the user results in the large, heavy door 19 closing on and crushing the user's fingers and hand 20. When using the disclosed safety device 10, however, as shown in FIG. 7, once the door 19 is open, the wedge member 15 of the device 10 falls between the open door 19 and the lockable receptacle 18, thereby preventing complete closure and latching of the door 19. This protects the user's body parts 20 (e.g., fingers, hands, etc.) from being crushed by the closing door 19.

Figure 8:
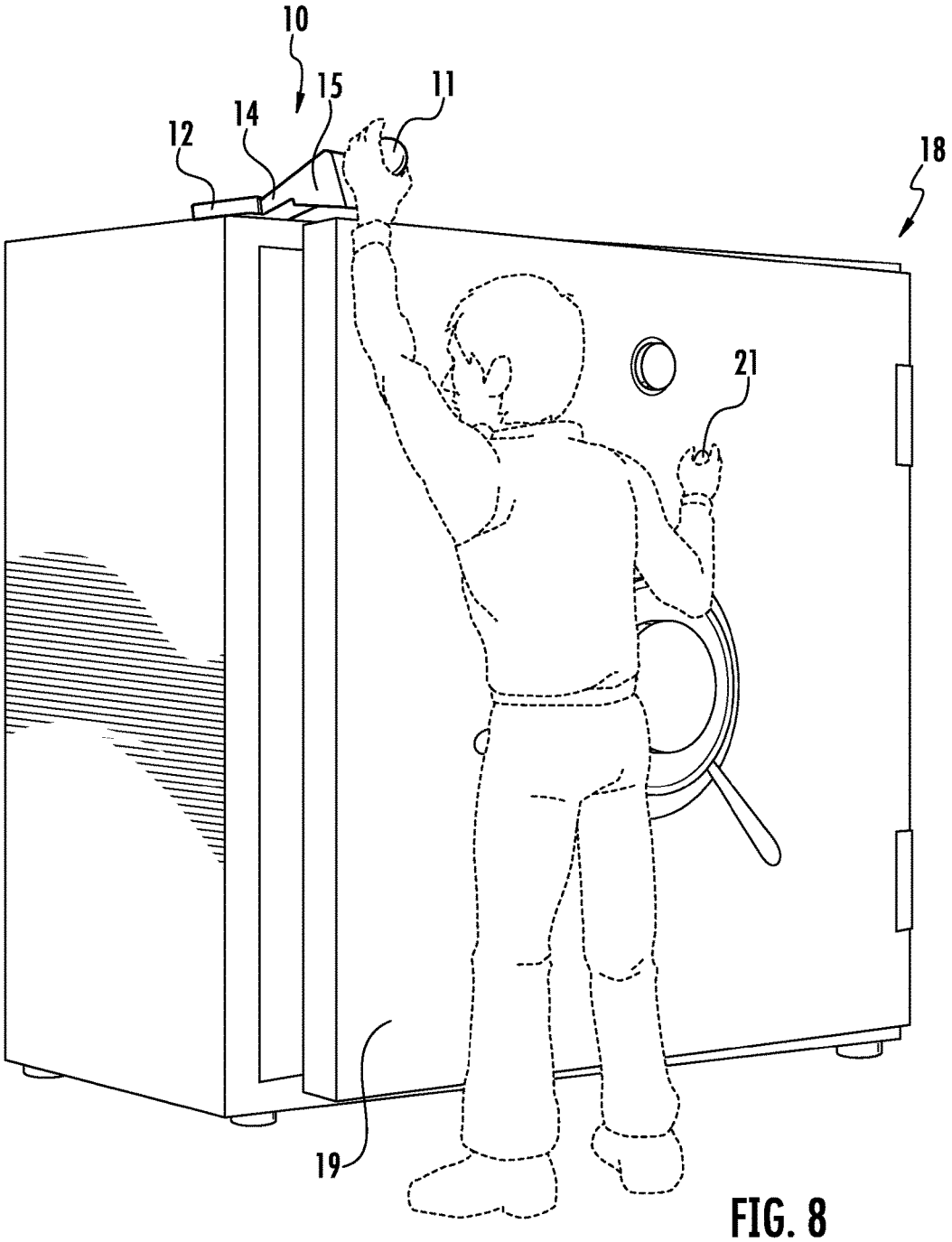
FIG. 8 is a perspective view of the device shown in FIG. 1, wherein the device is attached to a lockable receptacle and the device is being lifted to allow closure of the door of the lockable receptacle.

As depicted in FIG. 8, to bypass the safety device 10 in order to completely close and lock the lockable receptacle door 19, the user must use one hand to lift the handle member 11 or the distal end 24 of the arm member 14 of the device 10 so that the wedge member 15 no longer blocks or prevents the door 19 from completely closing. The user uses his other hand to push against the door 19 or door handle 21 to close the door 19. Since the user is using one hand to lift the handle member 11 of the safety device 10 and the other hand to push against the door handle 21, the user does not risk inadvertently closing the door 19 on the user's fingers or hand.

It is important to note that the construction and arrangement of the elements of the device provided herein are illustrative only. Although only a few exemplary embodiments of the present invention have been described in detail in this disclosure, those skilled in the art who review this disclosure will readily appreciate that many modifications are possible in these embodiments (such as variations in orientation of the components of the system, sizes, structures, shapes and proportions of the various components, etc.) without materially departing from the novel teachings and advantages of the invention.

Many other uses of the present invention will become obvious to one skilled in the art upon acquiring a thorough understanding of the present invention. Once given the above disclosures, many other features, modifications and variations will become apparent to the skilled artisan in view of the teachings set forth herein. Such other uses, features, modifications and variations are, therefore, considered to be a part of this invention, the scope of which is to be determined by the following claims.

The invention claimed is:

1. A safety device for a lockable receptacle, said lockable receptacle including a top wall, a bottom wall, two side walls, a rear wall and a door, said safety device comprising:

a base member attachable to said lockable receptacle;

an arm member having a proximal end and a distal end wherein said proximal end is attached to said base member; and a wedge member attached to said arm member, wherein said wedge member is not attached to said proximal end of said arm member, wherein said safety device is arranged and configured such that when said base member is attached to said top wall and said door is in a closed position, after opening said door, gravity forces said wedge member to pivot downwardly such that said wedge member becomes positioned between said open door and said top wall of said lockable receptacle, thereby preventing closure of said door on a user's body part positioned between said door and said lockable receptacle.

2. The device according to claim 1, wherein said base member is U-shaped.

3. The device according to claim 2, wherein said proximal end of said arm member is disposed within a cavity formed in said U-shaped base member.

4. The device according to claim 3, further comprising a fastener extending through a first projection of said U-shaped base member, said fastener further extending through said arm member, and said fastener further extending through a second projection of said U-shaped base member.

5. The device according to claim 1, wherein said wedge member is disposed toward the distal end of said arm member.

6. A safety device for a lockable receptacle, said lockable receptacle including a top wall, a bottom wall, two side walls, a rear wall and a door, said safety device comprising:

a base member attachable to said lockable receptacle;

an arm member having a proximal end and a distal end, wherein said proximal end is attached to said base member and wherein said arm member is extended to form a handle; and a wedge member forming a portion of said arm member, wherein said safety device is arranged and configured such that when said base member is attached to said top wall and said door is in a closed position, after opening said door, said wedge member pivots downwardly such that said wedge member becomes positioned between said open door and said top wall of said lockable receptacle, thereby preventing closure of said door on a user's body part positioned between said door and said lockable receptacle.

7. The device according to claim 1, wherein said wedge member is arranged and configured to allow said door of said lockable receptacle to open without requiring the user to manipulate said safety device.

8. The device according to claim 1, wherein said wedge member is triangular-shaped.

9. The device according to claim 1, wherein said wedge member is square-shaped.

10. The device according to claim 1, wherein said wedge member is rectangular-shaped.

11. A safety device for a lockable receptacle, said lockable receptacle including a top wall, a bottom wall, two side walls, a rear wall and a door, said safety device comprising:

a base member attachable to said lockable receptacle;

an arm member having a proximal end and a distal end, wherein said proximal end is attached to said base member;

a detachable handle member attached to said arm member, said handle member being arranged and configured to reposition the distal end of said arm member; and a wedge member forming a portion of said arm member, wherein said safety device is arranged and configured such that when said base member is attached to said top wall and said door is in a closed position, after opening said door, said wedge member pivots downwardly such that said wedge member becomes positioned between said open door and said top wall of said lockable receptacle, thereby preventing closure of said door on a user's body part positioned between said door and said lockable receptacle.

12. The device according to claim 11, wherein said arm member includes one or more handle connection members arranged and configured to attach said handle member to said arm member.

13. The device according to claim 12, wherein said one or more handle connection members define threaded apertures.

14. The device according to claim 13, wherein said handle member further includes a threaded fastener protruding from a bottom portion of said handle member, said threaded fastener of said handle member being configured to be received and retained by said one or more handle connection members.

15. The device according to claim 4, wherein said arm member is attached to said base member in a manner which allows said arm member to pivot freely about said fastener.

16. The device according to claim 1, wherein in order to completely close said door from said open position, said arm member, including said wedge member forming a portion of said arm member, is pivoted upwardly until said wedge member is no longer positioned between said open door and said lockable receptacle, thereby allowing a user to close said door.

17. A safety device for a lockable receptacle, said lockable receptacle including a top wall, a bottom wall, two side walls, a rear wall and a door, said safety device comprising:

a base member attachable to said lockable receptacle;

an arm member having a proximal end and a distal end wherein said proximal end is attached to said base member; and a wedge member forming a portion of said arm member, wherein said wedge member is attached to a central portion of said arm between said proximal end and said distal end, and wherein said wedge member is not attached to said proximal end of said arm member, wherein said safety device is arranged and configured such that when said base member is attached to said top wall and said door is in a closed position, after opening said door, gravity forces said wedge member to pivot downwardly such that said wedge member becomes positioned between said open door and said top wall of said lockable receptacle, thereby preventing closure of said door on a user's body part positioned between said door and said lockable receptacle.

18. The device according to claim 17, further including a handle member attached to said arm member, said handle member being arranged and configured to reposition said arm member.

19. The device according to claim 6, wherein said wedge member is disposed toward the distal end of said arm member.

20. The device according to claim 6, wherein said wedge member is disposed toward a center portion of said arm member between said proximal end and said distal end.

* * * * *